US005162010A

United States Patent [19]

Krebs

[11] Patent Number: 5,162,010

[45] Date of Patent: Nov. 10, 1992

[54] CARDBOARD TOY

[75] Inventor: Timothy A. Krebs, Englewood, Fla.

[73] Assignee: Brown Box Tool, Inc., Sarasota, Fla.

[21] Appl. No.: 661,680

[22] Filed: Feb. 27, 1991

[51] Int. Cl.[5] ..... A63H 33/10; A63H 9/00; A63H 33/14; B31B 1/72

[52] U.S. Cl. ..... 446/112; 446/113; 446/488; 446/901; 229/198; 229/198.1; 493/116; 493/382; 493/959

[58] Field of Search ..... 446/111, 112, 113, 230, 446/231, 478, 488, 901; 229/198, 198.1, 198.3, 125.39, 125.41; 403/231, 247, 405.1; 493/116, 347, 382, 383, 959

[56] References Cited

U.S. PATENT DOCUMENTS

| | | | |
|---|---|---|---|
| 121,156 | 11/1871 | Cohn | 229/198.1 |
| 889,651 | 6/1908 | Alwes | 229/198.1 |
| 1,533,011 | 4/1925 | Knaggs | 446/112 |
| 1,795,074 | 3/1931 | Conway | 446/113 |
| 2,871,619 | 2/1959 | Walters | 446/111 |
| 3,120,078 | 2/1964 | Bessinger | 446/112 |
| 3,438,562 | 4/1969 | Connor et al. | 229/117.02 |
| 3,542,637 | 11/1970 | Zoia | 229/125.41 |
| 3,659,376 | 5/1972 | Fischer | 446/113 |
| 4,212,130 | 7/1980 | Walker | 446/111 |

FOREIGN PATENT DOCUMENTS

| | | | |
|---|---|---|---|
| 911646 | 7/1946 | France | 446/111 |
| 914495 | 10/1946 | France | 446/111 |
| 1027845 | 5/1953 | France | 446/112 |
| 570570 | 12/1957 | Italy | 446/112 |

*Primary Examiner*—William E. Terrell
*Attorney, Agent, or Firm*—Charles J. Prescott

[57] ABSTRACT

A cardboard toy or the like formed from a pattern in-the-flat and method. The pattern includes a plurality of panels each defined by a combination of straight fold lines and edges. Adjacent and parallel to each edge is an elongated slot defining a flap or tab between the slot and edge and arranged such that, when the pattern is folded into the configuration of the toy, opposing pairs of flaps and spaced slots are brought together. A length of one sided adhesive tape is then passed through the slots and around the mating flaps and adhered to form a tight retaining band securing each connection.

4 Claims, 3 Drawing Sheets

CARDBOARD TOY

BACKGROUND OF THE INVENTION

This invention is related generally to toys which require assembly, and more particularly to a cardboard or paper toy in the flat which is assemblable about predetermined fold lines and utilizing a unique edge connection arrangement.

Children (and their parents) now enjoy a broad range of toys which are assemblable after purchase. Various components snap, twist, pop, clip, glue and stick together to form each particular toy.

The present invention provides for a unique fastening arrangement in conjunction with toys in-the-flat which are assemblable by folding about prescribed lines which define a series of panels of the toy. As each panel or toy segment is folded into position, a length of flexible adhesive tape is used to secure each junction that includes mating flaps defined by elongated slots or apertures through which the tape is passed. Assembly is easy and quick without the need for additional materials or tools and also provides a different sense of perspective in educating the child in construction generally.

BRIEF SUMMARY OF THE INVENTION

This invention is directed to a cardboard toy or the like formed from a pattern in-the-flat and method. The pattern includes a plurality of panels each defined by a combination of straight fold lines and edges. Adjacent and parallel to each edge is an elongated slot defining a flap or tab arranged such that when the pattern is folded into the configuration of the toy, opposing pairs of flaps and spaced slots are brought together a length of one sided adhesive tape is then passed through the slots and around the mating flaps and adhered to form a tight band securing each connection.

It is therefore an object of this invention to provide a two-be-assembled toy formed from a cardboard pattern in-the-flat which is easily assemblable into the toy by folding the pattern as specified in using a unique edge connection arrangement provided by this invention.

It is another object of this invention more generally to provide a unique connection between two cardboard panels.

It is yet another object of this invention to provide a method of assembling cardboard toys and mating cardboard panels.

In accordance with these and other objects which will become apparent hereinafter, the instant invention will now be described with reference to the accompanying drawings.

DETAILED DESCRIPTION OF THE INVENTION

Figure 4:
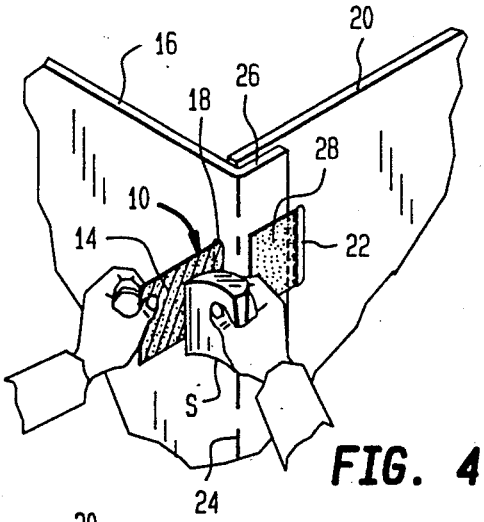
FIG. 4 is a perspective view of a next step following FIG. 3.
Figure 5:
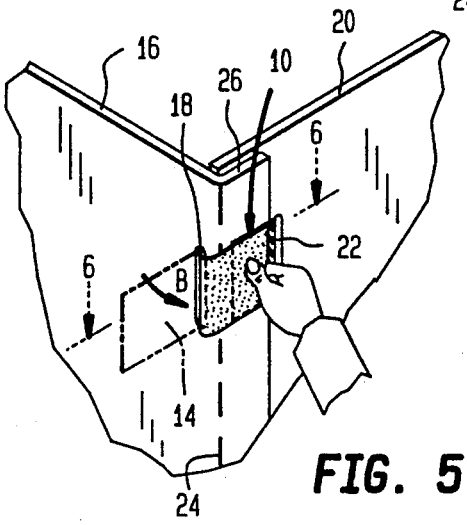
FIG. 5 is a perspective view of the final step of assembly following FIG. 4.
Figure 6:
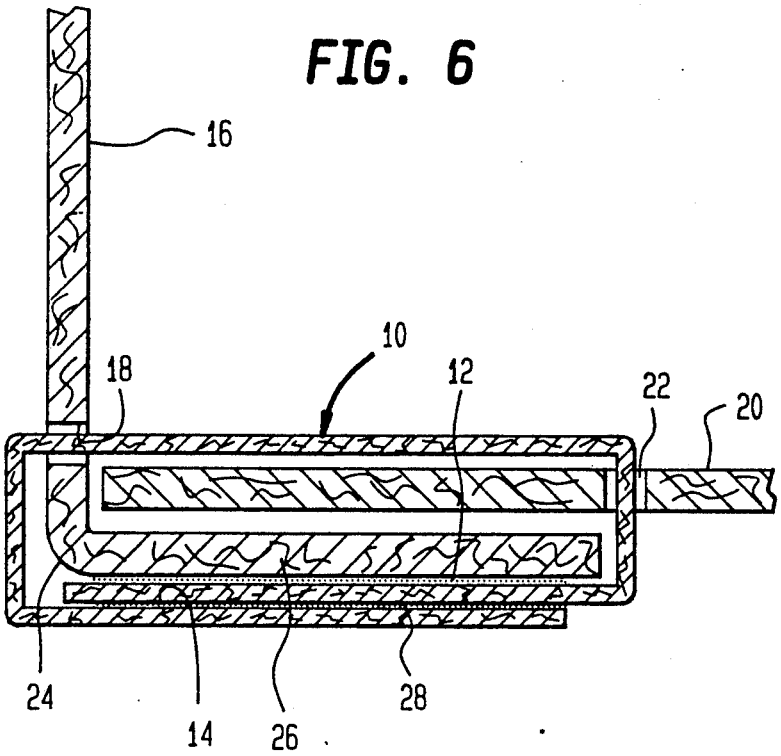
FIG. 6 is a section view in the direction of arrows 6—6 in FIG. 5.

Referring now to the drawings, one sequence of assembly events utilizing the present invention is depicted in FIGS. 1 to 5, along with a section view of the assembled connection shown in FIG. 6. Beginning at FIG. 1, two adjacent cardboard panels 16 and 20 are brought together as shown. Panel 16 includes a fold line 24 formed parallel to and spaced from its upright margin defining a flap or tab 26. An elongated upright slot 18 is formed immediately adjacent and parallel to fold line 24 and flap 26.

Panel 20 also includes an elongated upright slot 22 which is formed therethough and is spaced parallel to the upright margin of panel 20. The width of flap 26 is similar to the spacing of slot 22 from the upright margin of panel 20.

Figure 1:
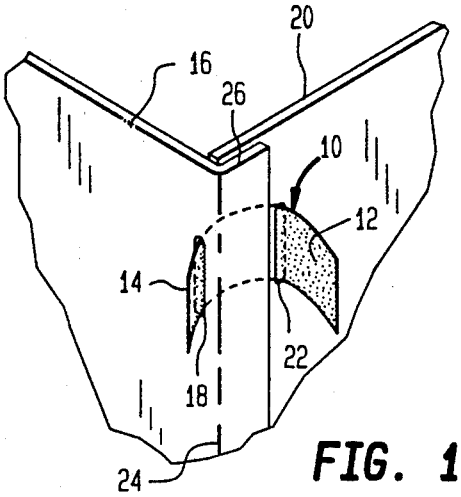
FIG. 1 is a perspective view of an initial step of assembling adjacent panels generally.
Figure 2:
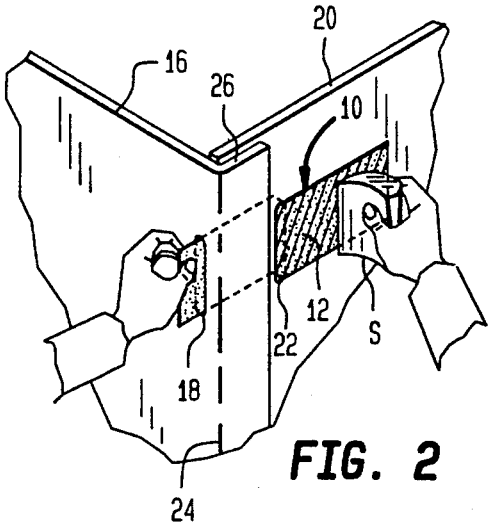
FIG. 2 is a perspective view depicting a next step following FIG. 1.
Figure 3:
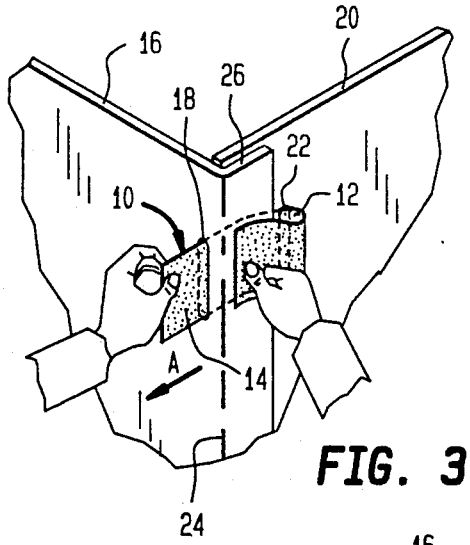
FIG. 3 is a perspective view depicting a next step following FIG. 2.

After flap 26 is brought against the edge and adjacent portion of panel 20 as shown in FIG. 1, a length of flexible one-sided adhesive tape 10 is passed through both slots 18 and 22. As seen in FIG. 2, adhesive surface 12 is moistened with sponge S and then, in FIG. 3, that adhesive surface 12 is applied against the outer surface of flap 26 as the opposite end of tape 10 is tensioned or pulled in the direction of arrow A.

In FIG. 4, the adhesive surface 14 is moistened by sponge S and then, in FIG. 5, surface 14 shown in phantom is brought in the direction of arrow B against the outer surface of the opposite end of tape 10 and adhered tightly in place.

By this arrangement, a retention band is formed from the length of adhesive tape 10 so as to fully secure this junction of panels 16 and 20 from further movement one to another. Because slots 18 and 22 are of a length similar to the width of tape 10, no relative vertical movement between panels 16 and 20 is likewise anticipated.

Figure 7:
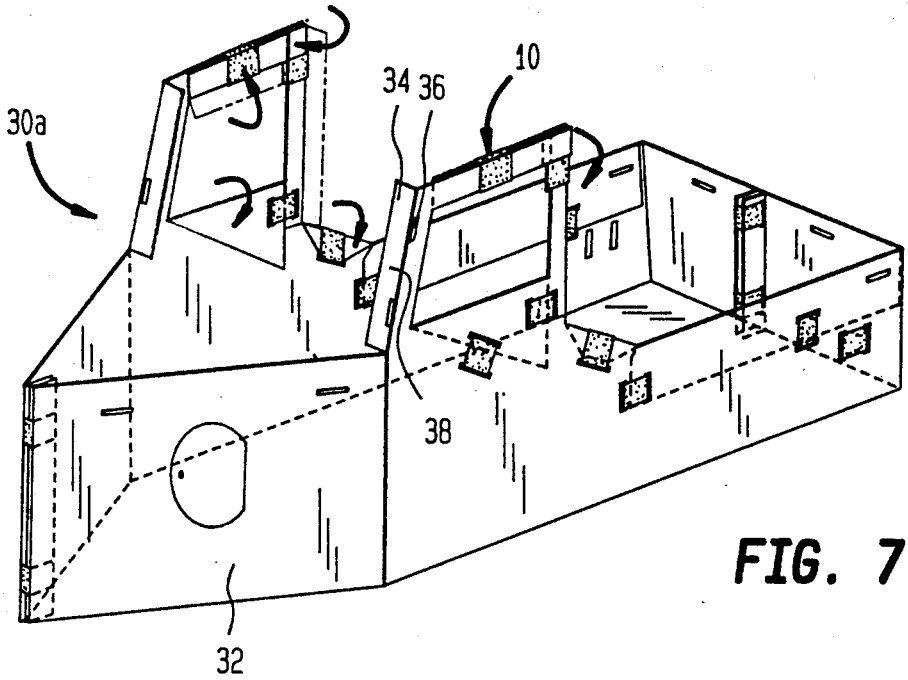
FIG. 7 is a perspective view of a partially assembled toy in the form of a boat utilizing the present invention.
Figure 8:
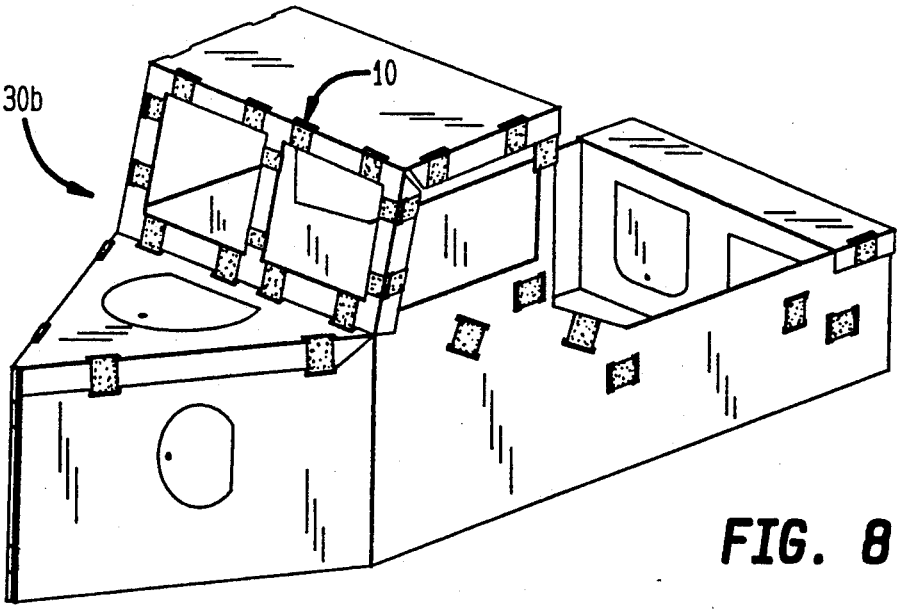
FIG. 8 is a perspective view of the fully assembled toy boat shown in FIG. 7.

The typical preferred embodiment of the invention is shown generally in FIGS. 7 and 8 at **30*a* and 30*b*. In FIG. 7, a toy in the form of a boat is shown partially assembled from a cardboard pattern in-the-flat. This pattern includes a plurality of panels shown typically at 32, a series of fold lines shown typically at 38 adjacent to which are positioned slots shown typically at 36. Flaps 34 as previously described, then mate against the next corresponding panel portion, after which adhesive tape 10 is adhered in accordance with the steps previously described in FIGS. 1–5 to form a retaining band at each panel junction. The fully assembled toy is shown in FIG. 8 at 30*b***.

Figure 9:
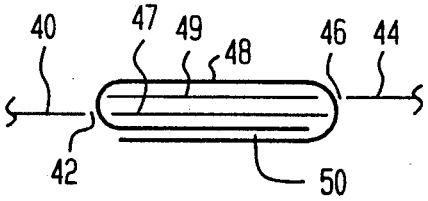
FIG. 9 is a cross section schematic view of one embodiment of a connection between adjacent cardboard panels utilizing the present invention.
Figure 10:
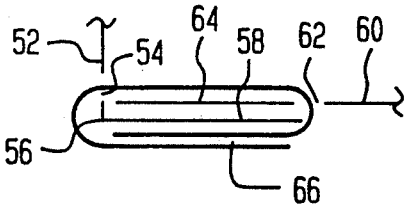
FIG. 10 is a cross section schematic of another embodiment of a connection between adjacent cardboard panels utilizing the present invention.
Figure 11:
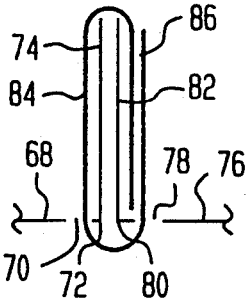
FIG. 11 is a cross section schematic view of yet another embodiment of a connection between adjacent cardboard members utilizing the present invention.

Referring lastly to FIGS. 9, 10 and 11, the invention is more generally described there in the form of interconnections between two adjacent cardboard panels. In FIG. 9, straight panels 40 and 44 each having elongated slots 42 and 46 spaced parallel to the edge or margin of each panel 40 and 46 define overlapping flaps 47 and 49. When panels 40 and 46 are brought into the alignment one to another shown in FIG. 9, a length of one-sided flexible adhesive tape 48 is passed at each end through slots 42 and 46 and then overlapped and adhered each end one to another at 50 forming a retention band.

In FIG. 10, a right angle connection between cardboard panels 52 and 60 is there depicted. Panel 52 includes a fold line at 56 defining flap 58. Panel 60 includes an elongated slot 62 adjacent its edge defining flap 64. Panel 52 also includes elongated slot 54 formed parallel and adjacent to fold line 56 and flap 58. When panels 52 and 56 are brought into the relationship shown in FIG. 10, a length of one-sided flexible adhesive tape 64 is passed at each end through similarly sized slots 54 and 60 and then around onto itself for adhesion at 66.

Another embodiment of the connection between two parallel and oppositely extending panels 68 and 76 is shown in FIG. 11. Panel 68 includes a fold line 72, while panel 76 includes fold line 80 each defining flaps 74 and 82, respectively. Slots 70 and 78 are formed adjacent each fold 72 and 80, respectively. When panels 68 and 76 are brought into the relationship shown in FIG. 11, a length of flexible one-sided adhesive tape is passed around and through each slot 70 and 78 and around flaps 74 and 82 to be adhered onto itself at 86 to form the retention band or connection.

Although the assemblable toy and panel interconnections are described with respect to cardboard panels and one-sided flexible adhesive tape, nonetheless this invention is intended to be applicable to similar articles manufactured of other materials such as plastics, light metals, rigid and semi-rigid thin synthetic materials, and the like.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A cardboard toy comprising:

a pattern in-the-flat including a plurality of configured first and second panels each defined by combination of a first and second plurality of straight edges and first fold lines;

each of said plurality of first and second panels including an elongated slot formed therethrough generally parallel to and spaced from one edge thereof defining a first and second flap, respectively, between each said slot and each said one edge;

said pattern and said first and second panels being arranged such that, when folded along said first fold lines into the configuration of said toy, each of said first and second flaps fully overlap and contact against one another;

a length of thin flexible tape having an adhesive surface on one side thereof, said tape having a width similar to the lengths of said slots;

said tape having a first and second end portion, said first end portion adhered against an exposed surface of said first slap, said tape extending from said first slap through said first slot, then through said second slot, said second end portion adhered against an exposed side of said first end portion.

2. A permanent connection between first and second flat stock panels comprising:

a length of thin flexible tape adhesively coated only on one side thereof;

said first panel having a first elongated first slot positioned generally parallel to and spaced form one edge thereof defining a first flap;

said second panel having a second slot positioned generally parallel to and spaced from one edge thereof defining a second flap;

said first and second flaps similar in width;

said first and second positioned in fully overlapping alignment and against one another whereby said first panel edge is positioned immediately adjacent said second slot and said second panel edge is aligned immediately adjacent said first slot;

said tape having a width corresponding to the length of said first and second slots;

said tape having a first and second end portion, said adhesive side of said first end portion adhered against an exposed surface of said first flap, said tape extending from said first flap through said first slot, then through said second slot, said adhesive side of said second end portion adhered against an exposed non-adhesive side of said first end portion.

3. A method of connecting first and second flat stock panels comprising the steps of:

A. forming a first elongated slot in said first panel generally parallel to and spaced from one edge thereof defining a first flap;

B. forming a second elongated slot in said second panel generally parallel to and spaced from one edge thereof defining a second flap; said first and second flaps similar in width;

C. positioning said first and second flaps fully overlapping and against one another whereby said first panel edge is positioned immediately adjacent said second slot and said second panel edge is aligned immediately adjacent said first slot, said first and second panels extending away from one another;

D. wrapping and adhering in place a length of thin flexible tape having an adhesive coating on only one side thereof around said first and second flaps and passing through said first and second slots to form a retaining band around said first and second flaps whereby the end portions of said tape overlap and are adhered one to another.

4. A method of constructing a cardboard toy from a pattern in-the-flat including a plurality of configured first and second panels each defined by combination of a first and second straight edge, respectively, and a firs fold line comprising the steps of;

A. forming a first elongated slot in said first panel generally parallel to and spaced from said first edge defining a first flap;

B. forming a second elongated slot in said second panel generally parallel to and spaced from said second edge defining a second flap; said first and second flaps similar in width;

C. folding said pattern and said first and second panels about each said first fold lines into the configuration of said toy and positioning said first and second flaps fully overlapping and against one another whereby said first panel edge is positioned immediately adjacent said second slot and said second panel edge is aligned immediately adjacent said first slot;

D. wrapping and adhering in place a length of thin flexible tape having an adhesive coating on one side thereof around each of said first and second flaps and passing through said first and second slots to form a retaining band around said first and second flaps whereby the end portions of said tape overlap and are adhered one to another.

* * * * *

UNITED STATES PATENT AND TRADEMARK OFFICE

CERTIFICATE OF CORRECTION

PATENT NO. : 5,162,010

DATED : November 10, 1992

INVENTOR(S) : Timothy A. Krebs

It is certified that error appears in the above-identified patent and that said Letters Patent is hereby corrected as shown below:

Column 3, Line 66, replace "slap" with -- flap --.

Column 3, Line 67, replace "slap" with -- flap --.

Column 4, Line 8, replace "form" with -- from --.

Column 4, Line 14, after "second", insert -- flaps --.

Column 4, Line 54, replace "firs" with -- first --.

Signed and Sealed this

Nineteenth Day of October, 1993

Bruce Lehman

*Attest:*

BRUCE LEHMAN

*Attesting Officer*

*Commissioner of Patents and Trademarks*